US006749369B2

(12) United States Patent
Garofalo

(10) Patent No.: US 6,749,369 B2
(45) **Date of Patent: *Jun. 15, 2004**

(54) EQUIPPED BALANCING JACKET

(75) Inventor: Giovanni Garofalo, Rapallo (IT)

(73) Assignee: HTM Sport S.p.A. (IT)

( * ) Notice: Subject to any disclaimer, the term of this patent is extended or adjusted under 35 U.S.C. 154(b) by 8 days.

This patent is subject to a terminal disclaimer.

(21) Appl. No.: 10/059,200

(22) Filed: Jan. 31, 2002

(65) Prior Publication Data

US 2003/0031515 A1 Feb. 13, 2003

(30) Foreign Application Priority Data

Aug. 10, 2001 (IT) ..... GE20001U023

(51) Int. Cl.[7] ..... B63C 11/02
(52) U.S. Cl. ..... 405/186; 441/114
(58) Field of Search ..... 405/185, 186; 441/96, 90, 92, 106, 114, 115, 116; 128/202.14

(56) References Cited

U.S. PATENT DOCUMENTS

| | | | | |
|---|---|---|---|---|
| 4,009,583 A | * | 3/1977 | Buckle | 405/186 |
| 5,370,113 A | * | 12/1994 | Parsons | 128/205.22 |
| 5,560,738 A | * | 10/1996 | Noel | 405/186 |
| 5,620,282 A | * | 4/1997 | Stinton | 405/186 |
| 6,287,053 B1 | | 9/2001 | Garofalo et al. | |

* cited by examiner

*Primary Examiner*—Heather Shackelford
*Assistant Examiner*—Lisa Saldano
(74) *Attorney, Agent, or Firm*—Stites & Harbison PLLC; Marvin Petry

(57) ABSTRACT

An equipped balancing jacket includes a back and a first stage reducer connected to the compressed air bottle/bottles. From the first stage reducer project high pressure and low pressure hoses. The high pressure hose is directly connected to a computer and/or a manometer, while the low pressure hose is connected to a dispenser from which project the hoses for different functions. Alternatively, the low pressure hoses is connected to the dispenser through the intermediary of an intermediate dispenser, from which projects also the hose for the connection to the control device.

2 Claims, 3 Drawing Sheets

EQUIPPED BALANCING JACKET

BACKGROUND OF THE INVENTION

In U.S. Pat. No. 6,287,053 filed on Feb. 23, 1999 and issued on Sep. 11, 2001 to the same Assignee, an equipped balancing jacket is described including a back with a first stage reducer, a high and low pressure dispenser and hose connections from which project hoses for different functions. The jacket includes exhaust valves with pneumatic or mechanical control, a manual emergency control and a mouth inflation device.

SUMMARY OF THE INVENTION

The present invention has as object some improvements to the device forming the object of the above mentioned patent, and in particular it relates to a new simplified circuit for the feeding of air at low and high pressure.

According to the present invention, two embodiments are provided, one involving the use of an intermediate low pressure dispenser, while in the other the intermediate dispenser is eliminated. In both embodiments, the high pressure air does not pass through the intermediate dispenser as in the above mentioned patent, but instead is connected directly to a computer and/or a manometer. Because of these features the advantage is obtained of an assembly which is less expensive, not as heavy and better contained within the jacket.

BRIEF DESCRIPTION OF THE DRAWINGS

Further features and advantages of the present invention will be apparent from the following description of preferred embodiments of the same, shown as a not limitative description in the enclosed drawings where.

DETAILED DESCRIPTION OF THE PREFERRED EMBODIMENTS

Figure 1:
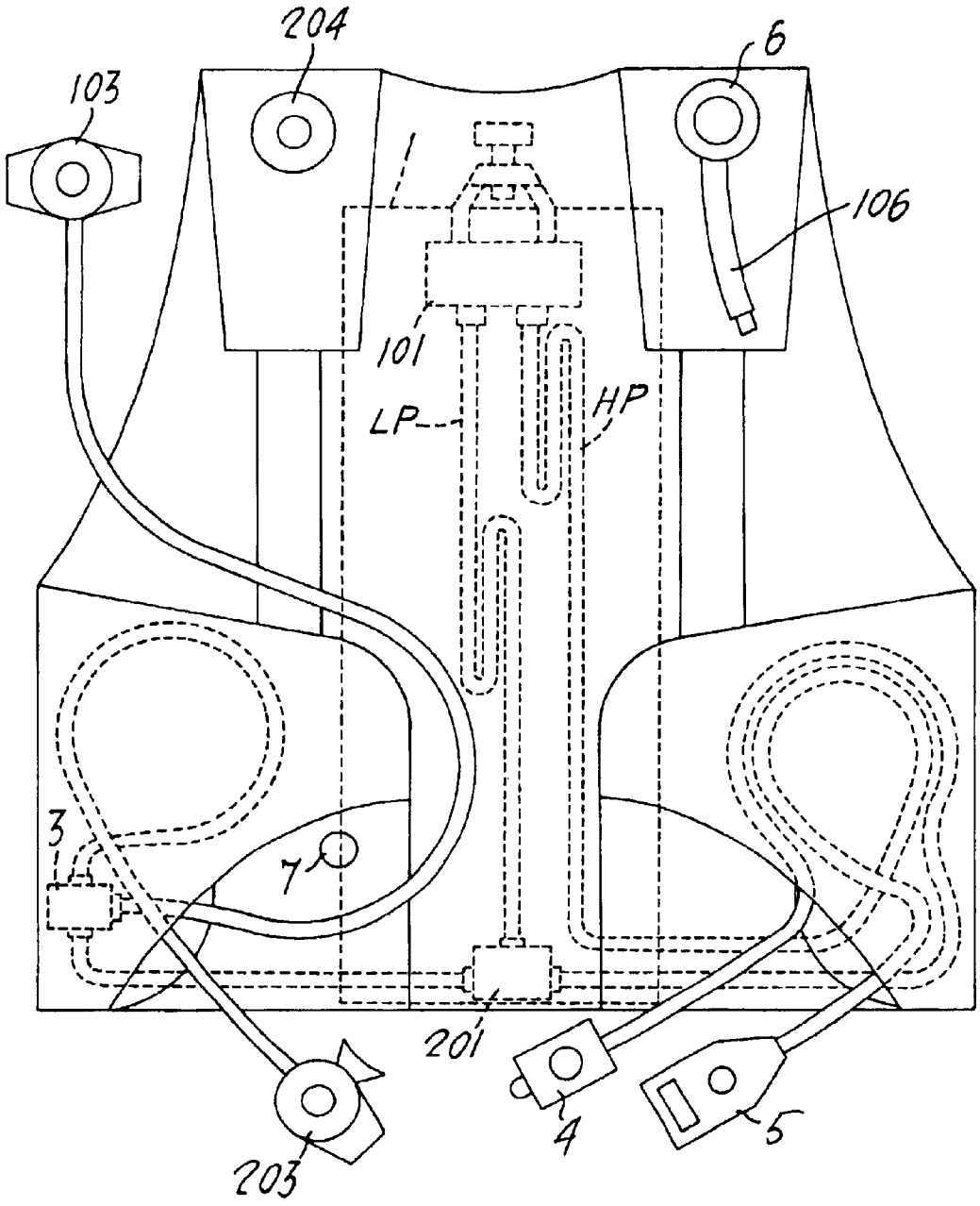
FIG. 1 is a front view of a balancing jacket according to a first embodiment form of the present invention.
Figure 2:
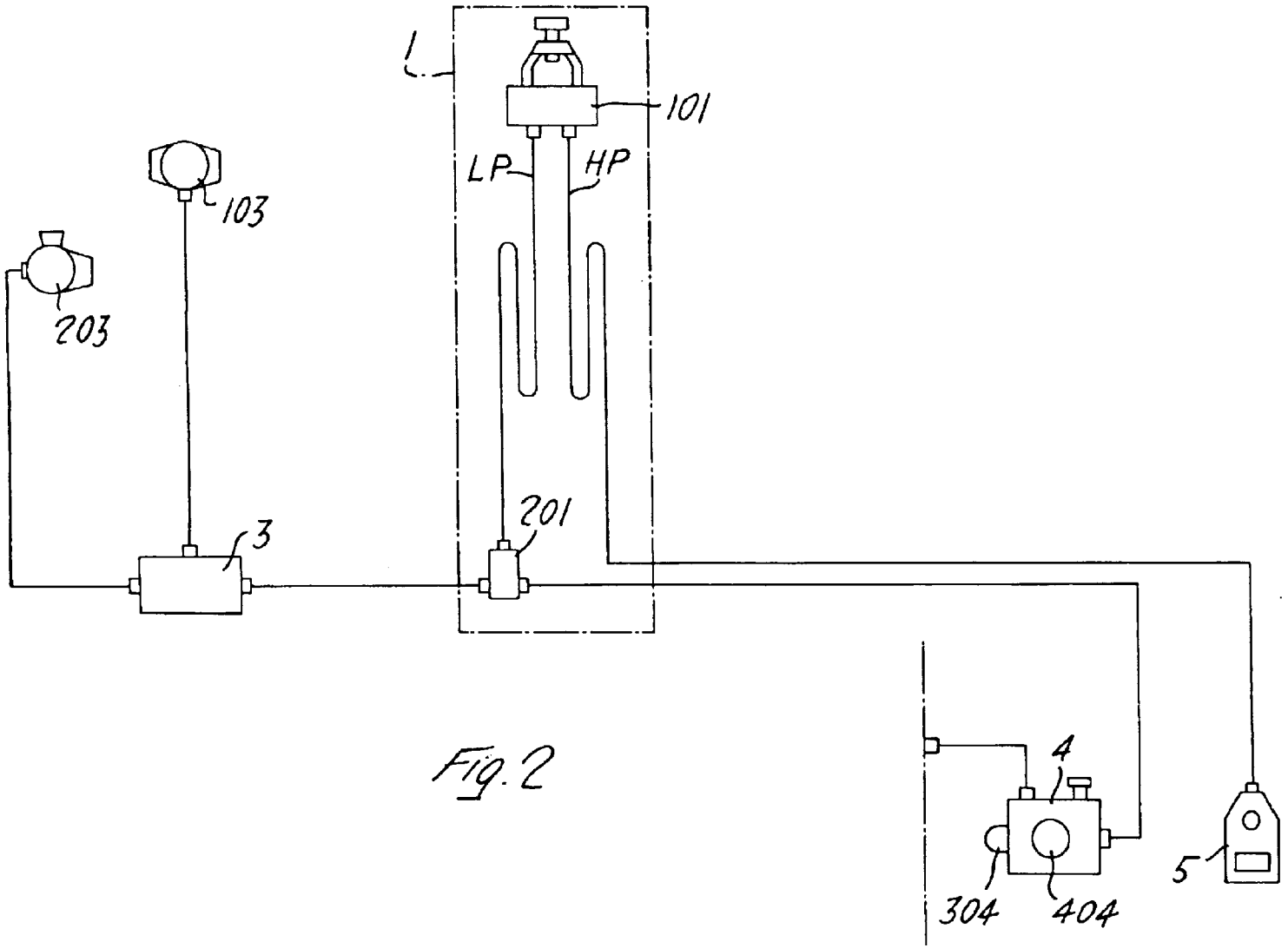
FIG. 2 schematically shows the connections of the jacket of FIG. 1.

With reference to the drawings, and with particular reference to FIGS. 1 and 2, the illustrated balancing jacket includes a back 1 and one part of textile material similar to the material of known jackets. At the upper part of the back 1 is the first stage reducer 101 which is connected to the bottle valve (not shown).

At the lower part of the back 1 is the first dispenser 201, which is a low pressure (LP) dispenser.

The jacket contains a second dispenser 3 which conveys the air for the second stage 103 or the emergency second stage 203. The upper exhaust valve 204 is visible on the jacket. The jacket also has a known second lower exhaust valve (not shown). The exhaust valves can be both pneumatically and manually controlled. As shown in FIG. 2, the first dispenser 201 is connected also to a control group 4 provided with loading button 304 and unloading button 404. From the reducer 101 projects a high pressure line, with a manometer or a computer 5. On the shoulders of the jacket are moreover visible the manual emergency control 6 and the mouth inflation tube 106. Cap 7 provides for air exhaustion from the jacket.

Figure 3:
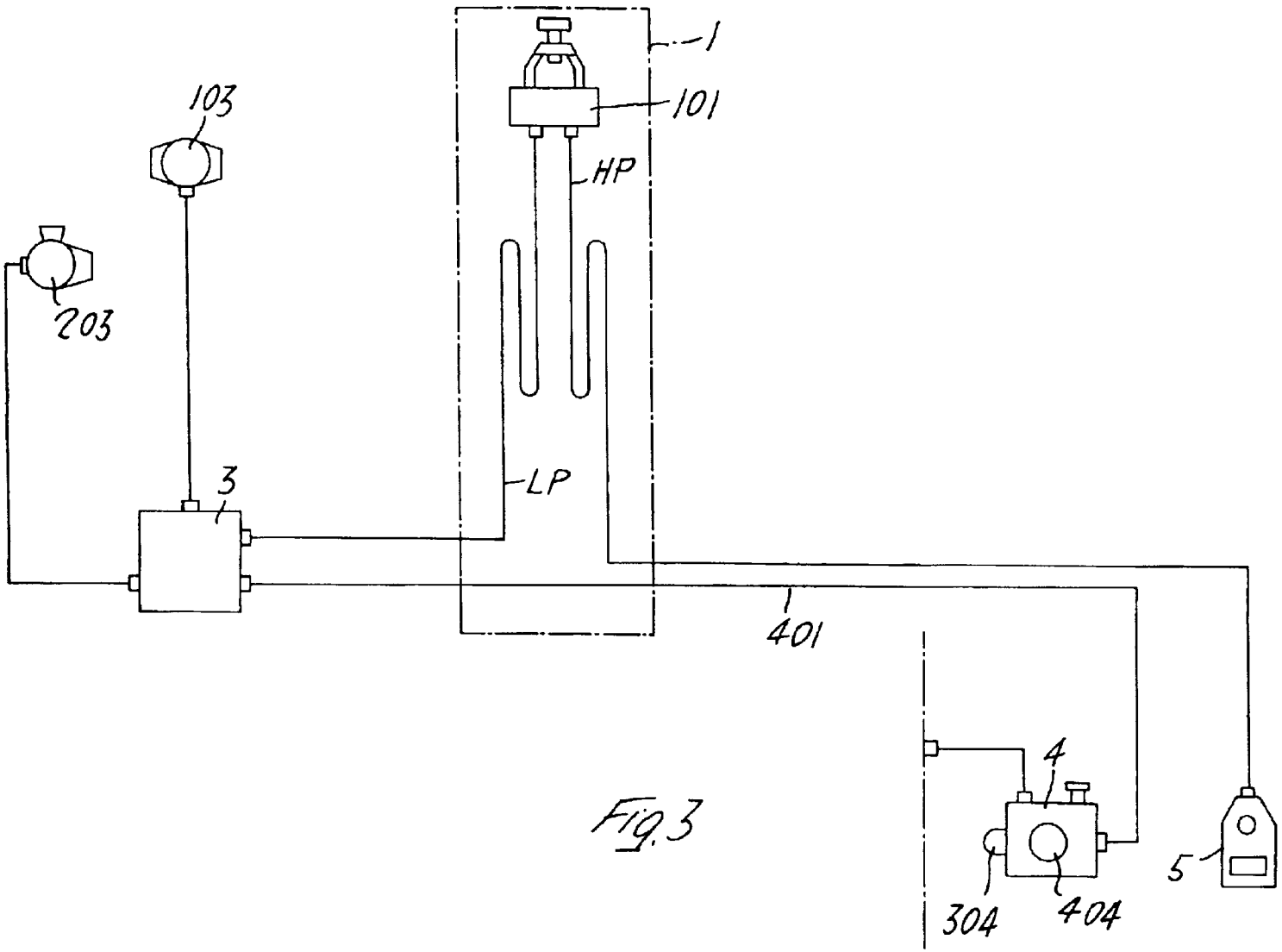
FIG. 3 schematically shows the connections according to another embodiment of the present invention.

FIG. 3 shows and alternative embodiment to the one shown in FIG. 2. The same numerals correspond to the same parts. According to this embodiment, the first dispenser 201 is eliminated, and the control group 4 is connected through the line 401 to a third outlet of the dispenser 3.

The operation of the described device is as follows:

With reference to the first embodiment shown in FIGS. 1 and 2, the air coming from the bottle enters the first stage 101, from which some air comes out of stage 101 having a low pressure (LP), while other air passes isobarically (HP). The hose LP passing through the inside of the jacket reaches the first dispenser 201, while the HP hose with the high pressure air goes directly to the pressure detector of the computer or to the manometer 5.

A portion of the low pressure air coming from the dispenser 201 passes through the second dispenser 3, from which project the hoses for the second stage 103 and the emergency second stage 203. The second dispenser 3 can even be absent, in which case the second stages 103 and 203 are connected directly to the first dispenser 201.

Another portion of low pressure air goes to the control group 4.

According to the embodiment of FIG. 3, the dispenser 201 is eliminated, and the LP hose goes directly to the dispenser 3, from which projects a hose 401 leading to the control group 4.

I claim:

1. An equipped balancing jacket comprising a back housing, a first stage reducer connected to at least one compressed air tank, a high pressure line and a low pressure line connected to and extending from said first stage reducer, the said high pressure line being directly connected to a computer and/or a manometer, while the said low pressure line is connected to a dispenser from which project lines for different functions.

2. An equipped balancing jacket according to claim 1, in which the said low pressure line is connected to the said dispenser through the intermediary of an intermediate dispenser, from which projects also a line for connection to a control device.

* * * * *